US006398926B1

(12) United States Patent
Mahneke

(10) Patent No.: US 6,398,926 B1
(45) Date of Patent: Jun. 4, 2002

(54) ELECTROPLATING APPARATUS AND METHOD OF USING THE SAME

(75) Inventor: Lotar Peter Mahneke, Buchholz (DE)

(73) Assignee: Techpoint Pacific Singapore Pte Ltd. (SG)

( * ) Notice: Subject to any disclaimer, the term of this patent is extended or adjusted under 35 U.S.C. 154(b) by 0 days.

(21) Appl. No.: 09/583,471

(22) Filed: May 31, 2000

(51) Int. Cl.[7] ..... C25D 17/00
(52) U.S. Cl. ..... 204/224 R
(58) Field of Search ..... 204/224 R

(56) References Cited

U.S. PATENT DOCUMENTS 5,507,923 A * 4/1996 Stouse et al. ..... 205/679

6,017,437 A * 1/2000 Ting et al. ..... 205/80

* cited by examiner

*Primary Examiner*—Kathryn Gorgos
*Assistant Examiner*—Thomas H Parsons
(74) *Attorney, Agent, or Firm*—Jon A. Gibbons; Fleit, Kain, Gibbons, Gutman & Bongini P.L.

(57) ABSTRACT

An electroplating chamber that allows substrates such as wafers to be effectively plated with the plating surface facing upwards. A method of reducing non-uniformity in the electroplating process is also disclosed. The chamber includes a bottom and a cover. The bottom contains a sidewall, an opening on top and securing means for securing substrates into the chamber during the plating process. At least one electrode retaining element is provided having at least one first electrode extending therefrom. The electrode retaining element is movable between an operating position and a release position. The cover contains a second electrode held above the substrate by an electrode holder.

9 Claims, 4 Drawing Sheets

ELECTROPLATING APPARATUS AND METHOD OF USING THE SAME

FIELD OF THE INVENTION

The present invention relates to electroplating technology. In particular, the present invention relates to apparatus for electroplating, and more particularly, for electroplating of semiconductor wafers.

BACKGROUND OF THE INVENTION

Deposition of metallic layers on semi-conductor wafers can be performed by electroless plating or electrolytic plating. In electrolytic plating, a wafer with a metallic seed layer is protected by a layer of photoresist, which in turn is etched by conventional photolithography to expose the prescribed pattern. Electroplating is then performed to deposit the selected metal or alloy on the pattern before the photoresist layer is removed. For flip chip production, an electroplating step is performed to produce the metallic input/output (I/O) pads that are required for electrical contact with external components. Solder bumps or stud bumps are then annealed or bonded onto the pads to form interconnections with the substrate.

The electroplating process typically involves the surface preparation, plating, rinsing and drying steps. Some of these steps require the use of corrosive chemicals that have to be carefully handled and contained. Therefore, it would be ideal to have the entire process confined within the same chamber. Furthermore, gas bubbles generated during electroplating tend to float upwards to adhere themselves to any object that is positioned near the top of the electrolyte solution. Thus, a system that allows the wafer to be positioned at the bottom of the electrolytic chamber is desired. In addition, rinsing and drying are often required for both the top and the bottom surfaces of the wafer, since the surface preparation fluid and electrolyte typically contaminate both surfaces. It is therefore an object of the present invention to provide a device that alleviates the aforementioned difficulties in electroplating.

SUMMARY OF THE INVENTION

Accordingly, the present invention provides, in one aspect, an electroplating chamber that allows flat-bottomed substrates, particularly disc-shaped substrates such as wafers to be effectively plated with the plating surface facing upwards. In another aspect, the substrate may be rotated to provided even plating. Rinsing and spin-drying may also be optionally applied such that the plating process assumes a convenient dry-in, dry-out process. In a further aspect, a method of reducing non-uniformity in the production process is provided using the apparatus according to the present invention.

The apparatus, constructed in accordance with the preferred embodiment, includes a chamber with a cover. The chamber is provided with a bottom having sidewall and an opening on top to allow access of the substrate to be plated. The bottom is provided with securing means for securing substrates into the chamber during the plating process and a barrier element adapted to contact the bottom edge of the substrate for preventing the electrolyte solution from flowing towards the bottom center of the substrate. Drainage means is provided in the chamber for draining liquids. At least one electrode retaining element having at least one first electrode extending therefrom. The electrode retaining element is movable between an operating position and a release position. The retaining element in the operating position is coupled to the bottom such that the first electrode is in contact with the substrate to be plated and is also electrically coupled to a power source. The retaining element in the release position is decoupled from the bottom to facilitate removal of the substrate.

The chamber can be closed by a chamber cover, which contains a supply mechanism for providing medium such as electrolyte or rinsing fluid into the chamber. The cover also contains a second electrode held above the substrate by an electrode holder. The electrode holder retains the second electrode juxtapose the substrate and defining a space therebetween wherethrough electrolyte solution flows during operation to complete the electrical connection. The two electrodes are connected to a DC power source during operation.

In the specific preferred embodiment, the electrode holder is a single-piece, ringed structure that can be coupled to a recess in the cover in the release position, such that lifting the cover will automatically move the ring away from the container. A series of vacuum outlets is provided at the sidewall of the chamber to secure the retaining element into the operating position. The bottom is preferably a rotatable chuck that allows processing while stationary, or during high speed or low speed spinning. This feature allows three steps of the electroplating process (i.e. plating, rinsing and drying steps) to be performed in the same chamber.

Using the apparatus according to the present invention, it is feasible and cost effective to have a sequential series of plating of a single substrate performed on different plating chambers. The method includes plating a fraction of the desired metallic layer in a first plating chamber, rinsing and drying the substrate with the partially plating surface; moving the partially plated substrate to a second chamber, and repeating the partial plating and rinsing/drying steps. Using this method, the non-uniformity in each chamber is evened out such that the resulting substrate contains an even and uniform plating layer.

DESCRIPTION OF THE INVENTION

The following detailed description describes the preferred embodiment for implementing the underlying principles of the present invention. One skilled in the art should understand, however, that the following description is meant to be illustrative of the present invention, and should not be construed as limiting the principles discussed herein. In the following discussion, and in the claims the terms "including", "having" and "comprising" are used in an openended fashion, and thus should be interpreted to mean "including but not limited to . . . ".

The electroplating apparatus according to the present invention is provided with a chamber to retain a wafer or other substrates to be plated. The bottom of the chamber is designed with raised vacuum outlets to allow suction forces to secure the wafer during the electroplating operation. This arrangement allows the wafer to be plated with the plating surface facing upwards. A barrier element is provided to prevent the electrolyte solution from flowing along the bottom of the wafer and into the vacuum outlet. Drainage means are provided in the chamber and supply lines provided on the cover and below the anode such that the electrolytic solution continuously flows in a top-to-bottom direction in the space between the anode and the wafer. Features are provided to allow the bottom of the chamber to rotate as described below.

Figure 1:
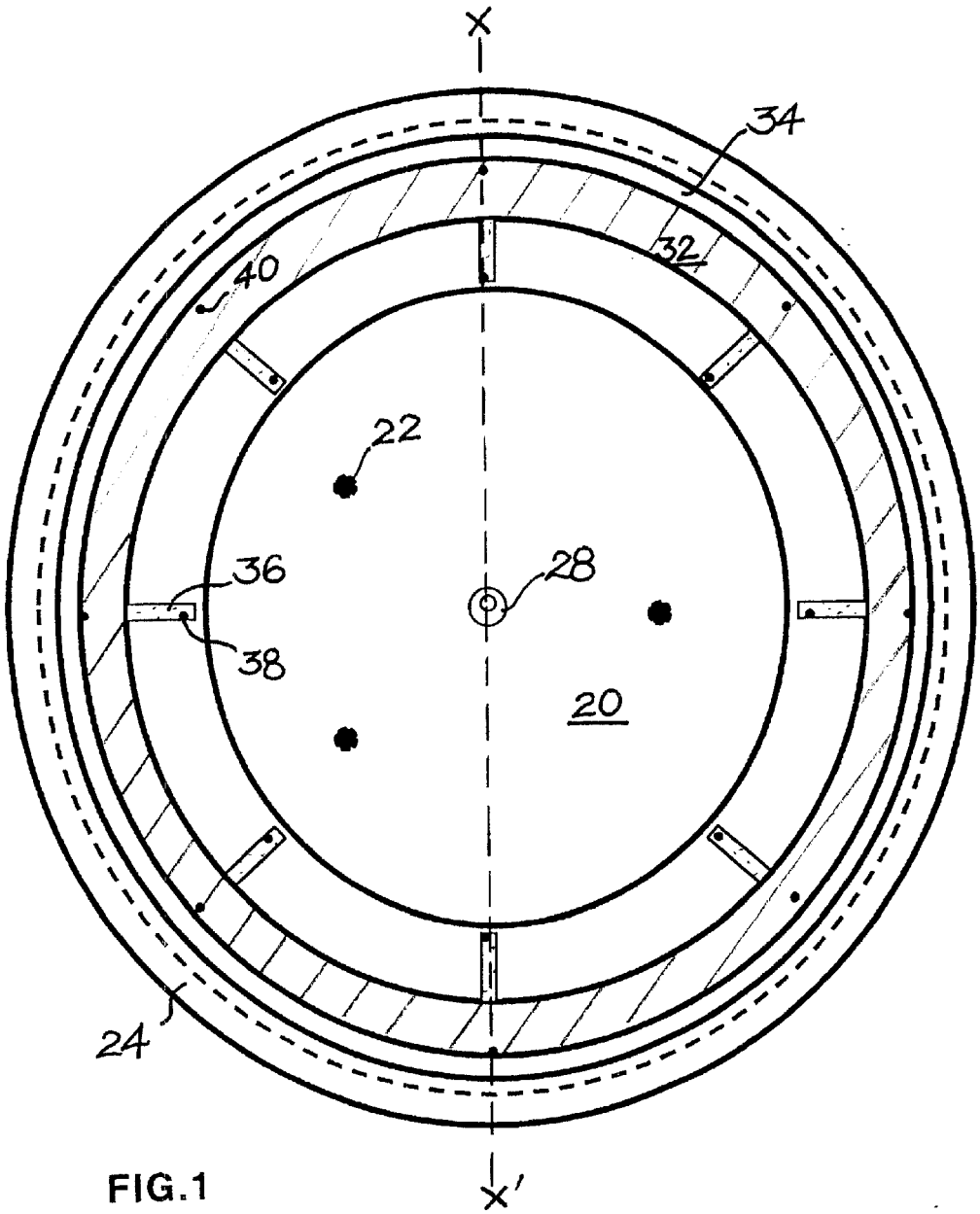
FIG. 1 is the bottom view of the cover of the electroplating chamber with the contact ring in the release position.

Referring first to FIG. 1, the electroplating anode 20 is shown in this embodiment as a metal grid, and is held by a plurality of heat isolating anode holders 22 to the cover plate 24 and connected to a power supply (not shown). The anode holder 22 is provided with adjusting mechanism for controlling the height of the anode. The cover is mounted on a lifting mechanism (not shown) to allow upward movement for opening the chamber for installing and removing wafers. A dispensing pipe 26 (see FIG. 4) is provided in the cover for dispensing electrolyte solution during operation. One end of the dispensing pipe 26 ends directly above the anode 20. The other end is connected to the supply of electrolyte solution. A second dispensing pipe 30 (see FIG. 4) is provided for dispensing other fluids into the chamber, such as water. The second dispensing pipe 30 also ends also ends directly above the anode. A contact ring 32 is reversibly mounted on a recess 34 within the cover. A plurality of contact fingers 36 are attached to the contact ring 32 and extend radially inwards at regular intervals toward the centre of the anode. A contact tip 38 extend downwards perpendicularly from the end of each contact finger. A plurality of metallic contact pins 40 provided at regular intervals along the contact ring extend downwards from the contact ring. The contact fingers 36 are made of an electrically conductive material such as metal or metal alloy, but are preferably coated with an electrically and chemically inert material to protect it from corrosive solutions used in the electroplating process.

Figure 2:
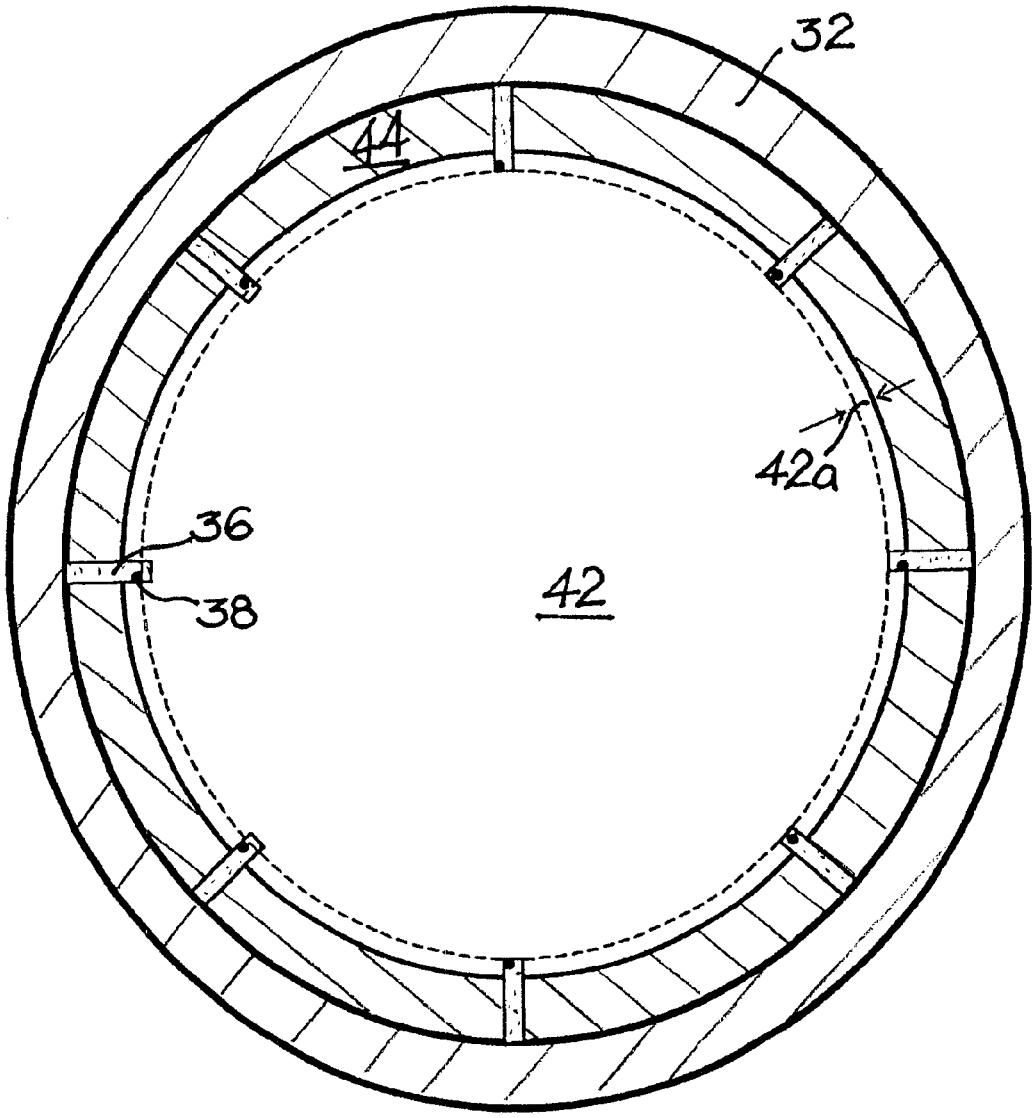
FIG. 2 is the top view of the bottom of the electroplating chamber with the contact ring in the operating position.

FIG. 2 shows a wafer 42 positioned on a chuck 44 that acts as the electroplating chamber according to the present invention. The wafer is secured onto the chuck by suction forces generated from suction tips 46 that are connected to a vacuum source via connection channels (see reference numeral 48 in FIG. 4). In this figure, the contact ring 32 is shown to be coupled to the chuck for ease of understanding. It is appreciated that only one contact ring is needed in the preferred embodiment, and that its position is movable between the cover plate and the chuck, with coupling to the former being the release position, and coupling to the latter being the operating position. The contact tips 38 of the contact fingers 36 are positioned to be in contact with the unprotected seed layer at the edge 42*a* of the wafer 42.

Figure 3:
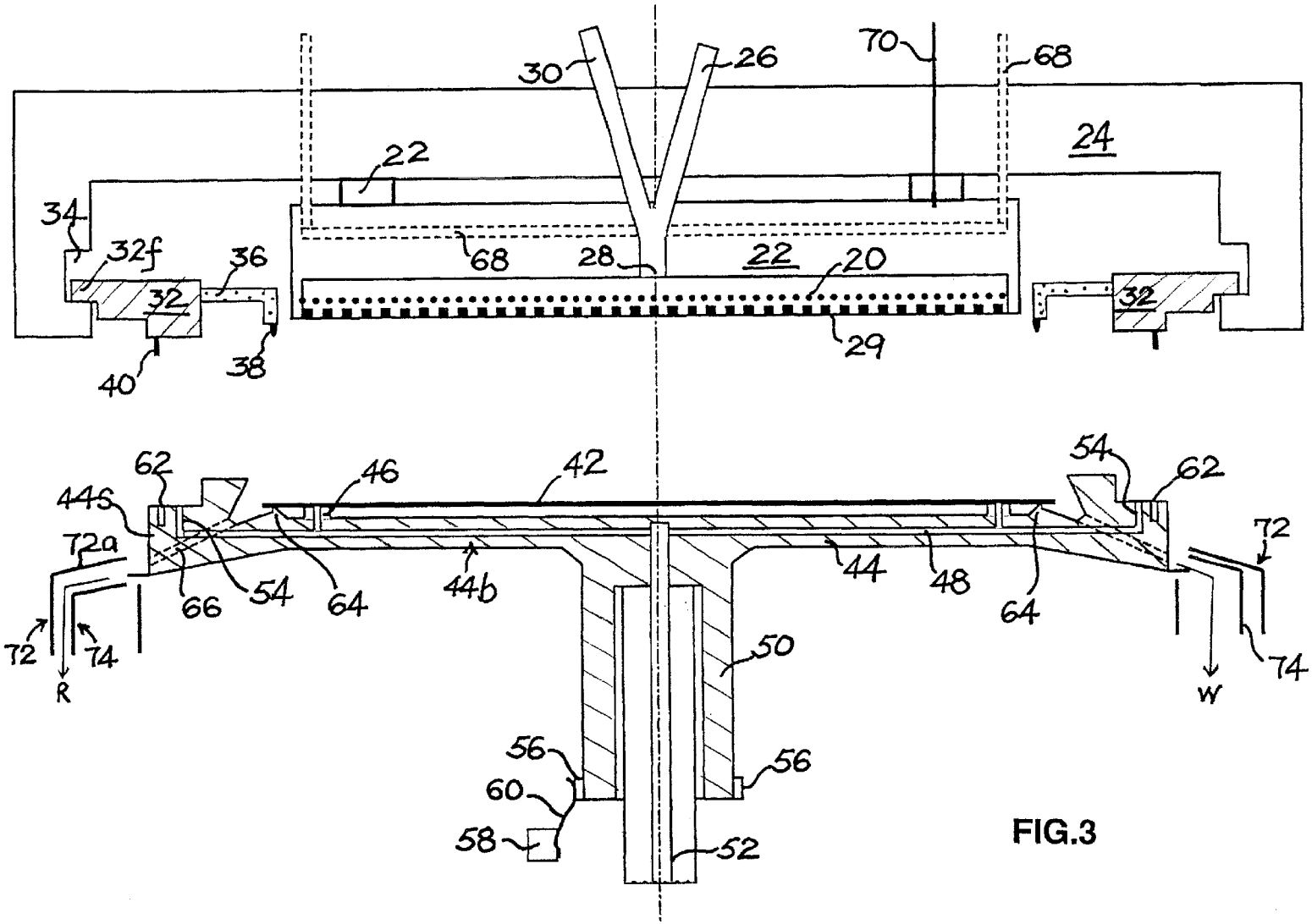
FIG. 3 is a cross sectional view of the chamber along line X-X' in the release position with the cover partially lifted. The inner catchcup on the left and right side of the drawing are shown in the lowered and raised positions respectively.
Figure 4:
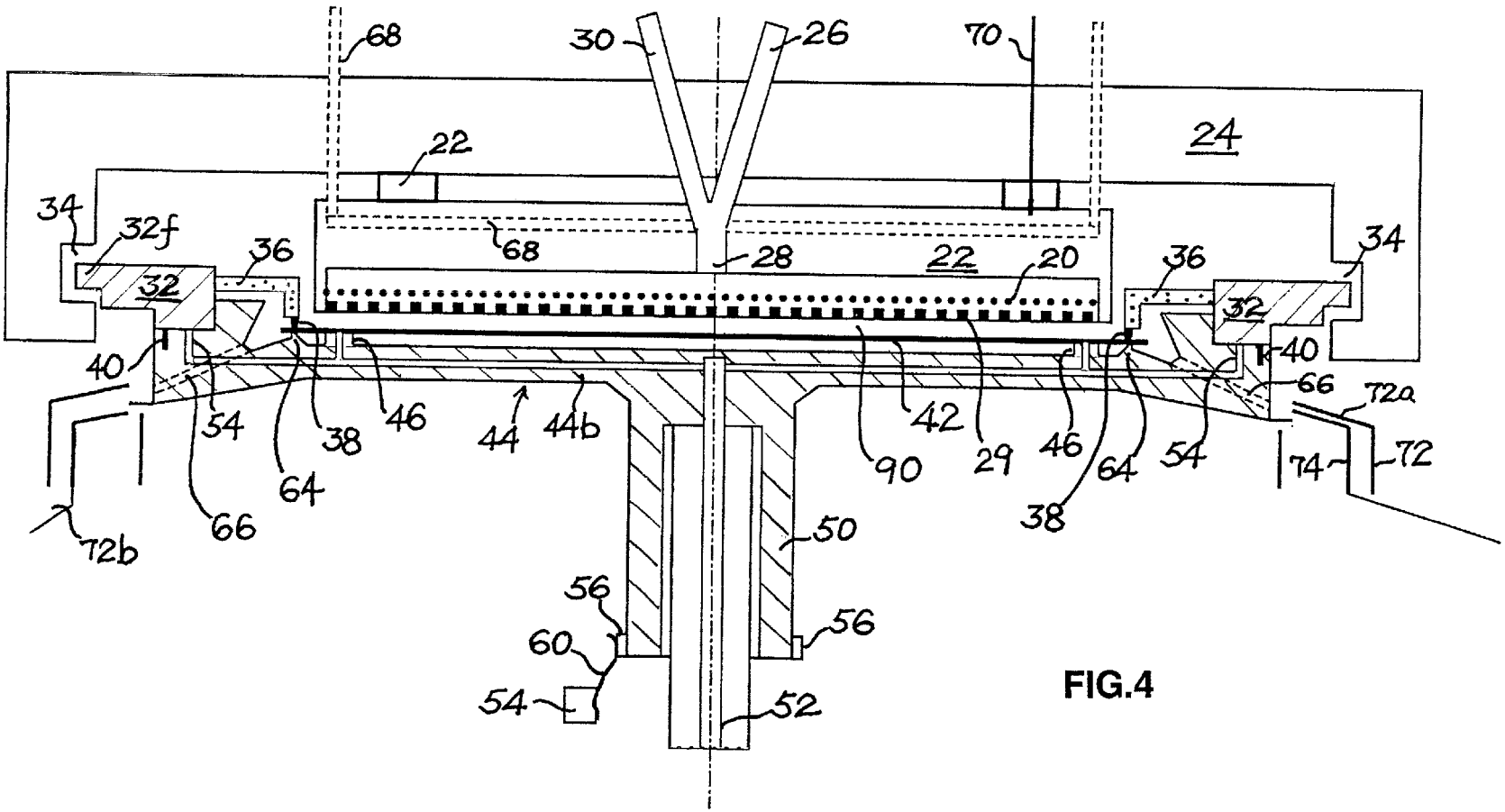
FIG. 4 is a cross sectional view of the chamber along line X-X' in the operating position. The inner catchcup on the left and right side of the drawing are shown in the lowered and raised positions respectively.

FIGS. 3 and 4 show in greater detail the chamber of the present invention. The chuck includes a bottom 44*b* and sidewall 44*s* to form into the shape of a flat-bottomed bowl or container. The chuck is mounted on a motor shaft 50 that is coupled to a motor (not shown). A radiafing network of connecting channels 48 and a vacuum supply line 52 connect a vacuum source (not shown) to the vacuum tip 46 on the chuck 44 and the vacuum conduit 54 at the side wall 44*s* of the chuck. The chuck is made from an electrically conductive material, such as metal or metal alloy, but with the exterior coated with an electrically and chemically inert coating such as PTFE, ECTFE and Teflon. A ring-shaped metallic contact bracket 56 is mounted at the shaft 50 of the chuck. The electrical supply source is connected to a contact brush 58 with metallic wires 60 in contact with the contact bracket 56. This provides the electrical contact for the cathode during electroplating. The contact tips 38 act as the cathode in this present embodiment. A plurality of sockets 62 (see FIG. 3) are provided in the side wall for mating with the connecting pins 40 that extend from the contact ring 32. The sockets 62 are not coated with the protective coating such that each of the metallic contact pin 40 is electrically coupled to the power supply via the metallic interior of the chuck. This in turn electrically couples the contact tips 38 to the power supply. The bottom of the chuck is provided with raised vacuum/suction tips 46 for securing the wafer in position. A ridge-like barrier ring 64 extends from the bottom of the chuck and runs in a circle concentric to the edge of the disc-shaped wafer 42. The diameter of the barrier ring 64 is preferably slightly smaller than the prescribed wafer size, and has the same height as the vacuum tips 46. Drainage channels 66 are provided at regular intervals around the bottom of the chuck.

The cover contains a cover plate 24 with the a disc-shaped anode grid 20 connected to height-adjustable holders 22. Anode grid 20 is electrically coupled to a DC power supply (not shown) via electrical contact 70. A thermocoupler (not shown), controls the temperature of fluids that flows through fluid channels 68 embedded within the anode. The first 26 and second 30 dispensing pipes are used as the supply mechanism for supplying all necessary medium for electroplating, rinsing and drying. An additional exhaust conduit (not shown) is provided between the cover plate 24 and anode 20 and may be connected to a suction pump for exhaust purposes. Attached below the anode is a distribution plate 29 that facilitates even distribution of fluids. The edge of the cover plate contains a recess 34 for coupling with the contact ring 32. However, in the operating position, there is no contact between the contact ring 32 and the cover of the chamber.

Two catchcups are provided along the entire edge of the chuck (only partially shown in FIGS. 3 and 4). The outer cup 72 is provided with an inwardly extending splash ring 72*a*. The edge of the splash ring is juxtapose drainage channel 66 and acts as a cover thereabove without being directly in contact therebetween.

During operation, the chamber is first set to the release position by switching off the vacuum source. In the release position, the outer flange 32*f* of the contact ring is snapped into the recess 34 such that the contact fingers 36 and contact tips 38 are also coupled to the cover plate 24. This allows the wafer to be loaded and unloaded without obstruction. The cover of the chamber is then opened and the wafer is loaded onto the chuck either manually or using a transfer mechanism such as a pick and place machine (not shown). The cover is then closed and the vacuum pump switched on. The suction tip 46 opening from the chuck would secure the wafer thereon during operation. At the same time, the contact ring 32 is also sucked onto the side wall of the chuck, causing pins 40 to mate with the sockets 62 and the contact tip 38 to electrically couple to the power supply.

For the electroplating process, electrolyte solution is pumped into the space 72 between the anode 20 and the wafer 42, and a voltage generated between the anode and cathode. The electrolyte solution flows from the electrolyte dispensing pipe 26 through the opening 28 in the centre of the anode and flows through the pores of the distribution plate towards and over the edge of the wafer. The solution then drops to the bottom of the chuck 44 and is drained through drainage channels 66. Some fluid will slide along the edge and onto the underside of the wafer, but is prevented from eaching the vacuum tips 46 by the barrier ring 64. This feature not only protects the vacuum source from contamination and damage, but also reduces the need to clean the underside of the wafer. The. chuck 44 can be optionally but preferably rotated to give even plating. The slight resilience of the metallic contact fingers 36 ensures that the contact tips 38 are in contact with the edge of the wafer. The edge of the wafer 42*a* (as indicated in the region between the arrows in FIG. 2) has been treated to remove the photoresist cover to allow electrical connection with the cathode. The entire chuck, including the contact ring, can rotate while the cover and the anode remain stationary. The exhaust pump (not shown) removes toxic fumes via an exhaust conduit (not shown).

After plating, the electrolyte solution is drained off and washing medium, such as distilled water, is supplied through the second dispensing pipe 30, also through the centre opening 28 through the anode. Since the electrical connection of the cathode and the anode with the power source is no longer required after plating, the contact brush 58 may be moved away from the base of the chuck so that there is no contact with metal contact bracket 56. This feature reduces wear and tear during the higher speed spin for drying. An optional spray tip (not shown) may be provided at the bottom of the chuck and aimed at the edge of the wafer to rinse the edge and lower rim of the. wafer that is not protected by barrier ring 64.

After rinsing, the chuck may be made to spin at a higher speed (e.g. 3,000 rpm) to remove the rinse fluid and dry the wafer. (For example, a third dispensing pipe may be provided for blow drying of nitrogen or other gases.) Once dried, the wafer may be removed by releasing the vacuum so that contact ring 32 is released from the chuck and the chamber can then be opened and the wafer removed.

During the electroplating process, the user has an option of collecting fluids for recycling, or removing them as waste. For recycling of fluids, the inner cup is lowered (see left side of FIGS. 3 and 4), such that the fluids being drained from drainage channels 66 run along the top surface of the inner cup 74 and into a recycling container as shown by arrow R. For waste fluids, the inner cup 74 is raised (see right side of FIGS. 3 and 4) such that fluids run under the lower surface of the inner cup into the waste container along arrow W.

The entire operation, together with the pick and place system, may be automatically and centrally controlled by a computerised control unit. The dry-in, dry-out capability of the present invention allows the possibility of using multiple chambers to participate in the growth of a single metal layer of a single wafer. For example, a metal layer of 72 $\mu$m will take 60 minutes to produce if the plating speed is 1.2 $\mu$m per minute. Instead of leaving the wafer in the same chamber for 60 minutes, the same wafer may be sequentially transferred into 8 separate plating chambers, with a plating time of 7.5 minutes in each chamber. This can be done efficiently using the apparatus described above because the rinsing and drying process is fast and effective. The advantage of growth in multiple chambers is that non-uniformity present in any individual chamber will not be amplified within the same wafer. Instead, the different non-uniformity of different chambers even each other out using the multi-chamber plating method, such that an extremely high level of consistency can be achieved for every wafer. Such a technique is particularly useful for plating thicker metal layers, such as those used for I/O pads on wafers for flip chip production.

The apparatus according to the present invention also has the capability of allowing for pre-processing steps, such as pre-plating treatment, to be performed within the same plating chamber.

While the present invention has been described particularly with references to FIGS. 1 to 4 with emphasis on a rotatable apparatus for electroplating of wafers, it should be understood that the figures are for illustration only and should not be taken as limitation on the invention. In addition, it is clear that the method and apparatus of the present invention has utility in many applications where electroplating is required. It is contemplated that many changes and modifications may be made by one of ordinary skill in the art without departing from the spirit and the scope of the invention described.

For example, additional dispensing pipes may be provided. In addition, decoupling of the contact ring may also be performed manual. The single-piece contact ring can also be divided into multiple pieces to facilitate manual removal. The substrate used for plating is described as a wafer. It is clear that any other disc-shaped object may also be plated in the same way. Furthermore, small modifications to the configuration of the features would allow objects that are not disc-shaped to be plated.

What is claimed is:

1. An electroplating apparatus comprising:

a substantially planar chuck having:

an upper surface for said substrate to be disposed thereon;

securing means located on said upper surface for securing said substrate thereon; and a barrier element extending from said upper surface, and said barrier element adapted to abut the bottom surface of said substrate, the barrier element for inhibiting fluid from flowing beyond the periphery of the bottom surface of said substrate;

s side wall extending upwardly from said upper surfacce for confining fluids on the upper surface of said substrate; and a drainage means extending through the upper surface, the drainage means being located where the upper surface meets the side wall, the drainage means for draining fluids;

an electrode retaining element movably mounted to a cover, the electrode retaining element having at least one first electrode extending therefrom, said electrode retaining element movable between an operating position where said cover and said chuck come together, and a release position where said cover and said chuck are apart, said electrode retaining element in said operating position being coupled to said chuck such that said first electrode is in electrical contact with said substrate, said electrode retaining element in said release position being decoupled from said chuck to facilitate removal of said substrate from said chuck; and the cover for engaging with the chuck to form a chamber when in the operating position, the cover comprising:

a supply mechanism from which fluids are supplied into said chamber;

an electrode holder, disposed thereunder, being coupled to a second electrode, said second electrode positioned above said substrate and defining a space therebetween wherethrough electrolyte solution flows during operation.

2. An apparatus according to claim 1 wherein said retaining element further comprises:

a non-electrically conducting contact ring, said ring in said release position coupled to said cover such that lifting said cover in the release position automatically moves said retaining element away from said bottom;

a plurality of metallic contact pins each having a first end and a second end, said first end embedded within said ring, said second end extending from said ring;

a plurality of electrically conductive contact fingers functioning as said first electrode, said contact fingers having a first end embedded within said ring and a second end extending radially inwardly from said ring, said first end of said contact finger electrically connected to said first end of said contact pins;

said side wall of said chuck further having a plurality of sockets adapted to mate with said second end of said contact pins when the retaining element is in the operating position, said socket for providing electrical connection between said contact fingers and a power source.

3. An apparatus according to claim 2 wherein said chuck is a rotable chuck coupled to a motor, said retaining element and said first electrode in the operating position adapted to rotate with said chuck while the cover remains stationary.

4. An apparatus according to claim 2 wherein said contact ring includes a flange, said flange adapted to mate with a recess in said cover in the release position, said chuck further having at least one conduit with one end for connecting to a vacuum source and a second end opening from said side wall to allow pulling of said contact ring into said operating position by suction.

5. An apparatus according to claim 2 wherein said securing means is a plurality of vacuum tips extending from said upper surface; and said barrier element is a barrier ring having a ridge protruding therefrom extending from said upper surface, said barrier ring having substantially the same height as the vacuum tips and positioned proximate the periphery of said substrate.

6. An electroplating apparatus comprising:

a chamber for retaining a substrate to be elecroplated comprising:

a bottom having an opening on top to allow said substrate to be lowered therefrom;

securing means for securing said substrate thereon during during operation; and a barrier element extending therefrom and adapted to contact the bottom edge of said substrate for preventing electrolyte from flowing towards the bottom of said substrate;

drainage means for draining liquids; and side wall extending from said bottom for confining fluids within said chamber;

an electrode retaining element having at least one first electrode extending therefrom, said retaining element movable between an operating position and a release position, said retaining element in said operating position being coupled to said bottom such that said first electrode is in electrical contact with said substrate and electrically coupled to a power source, said retaining element in said release position decoupled from said bottom to facilitate removal of said substrate;

a cover for said chamber comprising:

a supply mechanism from which fluids are supplied into said chamber;

an electrode holder, disposed thereunder, being coupled to a second electrode, said second electrode positioned above said substrate and defining a space therebetween wherethrough electolyte solution flows during operation;

a power source adapted for electrical coupling with said first and second electrode for electrical connected therebetween;

wherein the electrode retaining element further comprises:

a non-electrically conducting contact ring, said ring in said release position coupled to said cover such that lifting said cover in the release position automatically moves said retaining element away from said bottom;

a plurality of metallic contact pins each having a first end and a second end, said first end embedded within said ring, said second end extending from said ring;

a plurality of electrically conductive contact fingers functioning as said first electrode, said contact fingers having a first end embedded within said ring and a second end extending radially inwardly from said ring, said first end of said contact finger electrically connected to said first end of said contact pins;

wherein said side wall of said bottom further having a plurality of sockets adapted to mate with said second end of contact pins when the retaining element is in the operating position, said socket adapted to provide electrical connection between said contact fingers and said power source;

wherein said securing means comprises a plurality of vacuum tips extending from said bottom of said chamber; and wherein said barrier element comprises a barrier ring having a ridge protruding therefrom extending from said bottom, said barrier ring having the same height as the vacuum tip and positioned proximate the edge of said substrate.

7. An apparatus according to claim 6 wherein said bottom is a rotable chuck coupled to a motor, said retaining element and said first electrode in the operating position adapted to rotate with said chuck while the cover remains stationary.

8. An apparatus according to claim 6 wherein said contact ring includes a flange, said flange adapted to mate with a recess in said cover in the release position, said bottom further having at least one conduit with one end connected to a vacuum source and a second end opening from said side wall to allow pulling of said contact ring into said operating position by suction.

9. An apparatus for electroplating a semiconductor wafer, the apparatus comprising:

a cover having an anode adjustably mounted therein;

a cathode ring having a plurality of contact fingers extending radially inwards and having coupling features thereon, the cathode ring being movably mounted to the cover;

a bottom having vacuum tips and a ridge protruding therefrom to substantially the same height, the vacuum tips for securing the semiconductor wafer thereto by applying a vacuum to a lower surface of the semiconductor wafer, the ridge for forming a seal between the lower surface of the substrate to inhibit flow of fluids along the lower surface of the substrate, and the bottom having corresponding coupling features thereon;

wherein in a release position the cover and the bottom are spaced apart to allow the semiconductor to be disposed on the bottom and retrieved therefrom;

wherein in an operational position the cover and the bottom come together, the coupling features on the cathode ring engaging with the corresponding coupling features on the bottom, and the plurality of contact fingers abutting upper surface of the semiconductor wafer; and wherein at least the anode and at least one of the contact fingers for coupling to a power source while electrolyte flows through an inlet in the cover and drains via an outlet in the bottom.

* * * * *

UNITED STATES PATENT AND TRADEMARK OFFICE

CERTIFICATE OF CORRECTION

PATENT NO. : 6,398,926 B1
DATED : June 4, 2002
INVENTOR(S) : Lotar Peter Mahneke It is certified that error appears in the above-identified patent and that said Letters Patent is hereby corrected as shown below:

Title page,
Item [56], References Cited, under "*Attorney, Agent or Firm*", please add:
-- Lawrence Y.D. Ho & Associates Pte Ltd. --

Signed and Sealed this

Twenty-third Day of July, 2002

*Attest:*

*Attesting Officer*

JAMES E. ROGAN
*Director of the United States Patent and Trademark Office*